US009409212B2

(12) United States Patent
Käske

(10) Patent No.: US 9,409,212 B2
(45) Date of Patent: Aug. 9, 2016

(54) NOZZLE APPARATUS AND CLEANING APPARATUS HAVING SUCH NOZZLE APPARATUS

(71) Applicant: Dürr Ecoclean GmbH, Filderstadt (DE)

(72) Inventor: Egon Käske, Aachen (DE)

(73) Assignee: Dürr Ecoclean GmbH, Filderstadt (DE)

( * ) Notice: Subject to any disclaimer, the term of this patent is extended or adjusted under 35 U.S.C. 154(b) by 465 days.

(21) Appl. No.: 13/965,744

(22) Filed: Aug. 13, 2013

(65) Prior Publication Data

US 2013/0333732 A1 Dec. 19, 2013

Related U.S. Application Data

(63) Continuation-in-part of application No. PCT/EP2012/050631, filed on Jan. 17, 2012.

(30) Foreign Application Priority Data

Feb. 16, 2011 (DE) ..... 10 2011 004 232

(51) Int. Cl.

| | |
|---|---|
| ***B08B 3/00*** | (2006.01) |
| ***B08B 3/10*** | (2006.01) |
| ***B05B 1/04*** | (2006.01) |
| ***B08B 3/02*** | (2006.01) |

(52) U.S. Cl.

CPC ..... *B08B 3/102* (2013.01); *B05B 1/044* (2013.01); *B08B 3/02* (2013.01)

(58) Field of Classification Search

None

See application file for complete search history.

(56) References Cited

U.S. PATENT DOCUMENTS

| | | | |
|---|---|---|---|
| 4,515,313 | A | 5/1985 | Cavanagh |
| 5,000,795 | A | 3/1991 | Chung et al. |
| 5,540,247 | A | 7/1996 | Kawatani et al. |
| 6,199,568 | B1 | 3/2001 | Arai et al. |

FOREIGN PATENT DOCUMENTS

| | | |
|---|---|---|
| DE | 2409 544 | 9/1974 |
| DE | 28 55 906 | 7/1980 |

(Continued)

OTHER PUBLICATIONS

International Searching Authority,"International Preliminary Report on Patentanility", issued in connection with International Patent Application No. PCT/EP2012/050631, mailed Aug. 29, 2013, 10 pages.

German Patent Office, "Search Report," issued in corresponding German Application No. 10 2011 004 232.6 on Nov. 28, 2011, 12 pages.

(Continued)

*Primary Examiner* — Eric Golightly

(74) *Attorney, Agent, or Firm* — Hanley, Flight and Zimmerman, LLC

(57) ABSTRACT

A nozzle apparatus for the generation of at least one fluid stream, the nozzle apparatus comprising: a body having a nozzle chamber comprising a nozzle opening for generating a fluid stream, wherein the body is rotatably mounted on a unit and is movable about a rotation axis, wherein the nozzle opening comprises a wall and a slit-shaped nozzle mouth extending along a slit axis, and wherein the nozzle chamber opens into an opening slot formed in the wall of the body between the nozzle mouth and the nozzle chamber, fluid being fed to the opening slot through an opening in a hollow body via a stream path directed by wall sections of the nozzle chamber to the opening slot, wherein the wall sections are located opposite the opening.

18 Claims, 8 Drawing Sheets

(56) References Cited

FOREIGN PATENT DOCUMENTS

| | | |
|---|---|---|
| DE | 33 33 802 | 3/1984 |
| DE | 87 03 114.0 | 4/1987 |
| DE | 43 31 496 | 4/1994 |
| DE | 93 30 624.0 | 10/1994 |
| GB | 2 127 326 | 4/1984 |
| WO | 2009/144073 | 12/2009 |

OTHER PUBLICATIONS

Patent Cooperation Treaty, "International Search Report," issued by the International Searching Authority in connection with PCT Application No. PCT/EP2012/050631, mailed Oct. 2, 2012 (7 pages).

Patent Cooperation Treaty, "Written Opinion of the International Searching Authority," issued by the International Searching Authority in connection with PCT/EP2012/050631, mailed Oct. 2, 2012 (16 pages).

NOZZLE APPARATUS AND CLEANING APPARATUS HAVING SUCH NOZZLE APPARATUS

RELATED APPLICATION

This patent arises from a continuation-in-part of International Patent Application No. PCT/EP2012/050631, which was filed on Jan. 17, 2012, which claims priority to German Patent Application No. 10 2011 004 232.6, which was filed on Feb. 16, 2011, both of which are hereby incorporated herein by reference in their entireties.

FIELD OF THE DISCLOSURE

This disclosure relates generally to nozzle apparatus and, more particularly, to nozzle apparatus and cleaning apparatus having such nozzle apparatus.

BACKGROUND

In the mechanical machining of workpieces such as engine components (e.g., cylinder heads), cooling lubricants are used and shavings are created. As a result, workpieces are contaminated. These contaminations may cause disruptions during downstream assembly processes and compromise the technical functionality of systems which are made of corresponding workpieces. Contaminations caused by cooling lubricants and shavings in cylinder head borings and injection nozzles carry the risk of engine damage which is beyond repair, particularly in the case of internal combustion engines.

BRIEF DESCRIPTION OF THE DRAWINGS

Wherever possible, the same reference numbers will be used throughout the drawing(s) and accompanying written description to refer to the same or like parts.

DETAILED DESCRIPTION

Figure 1:
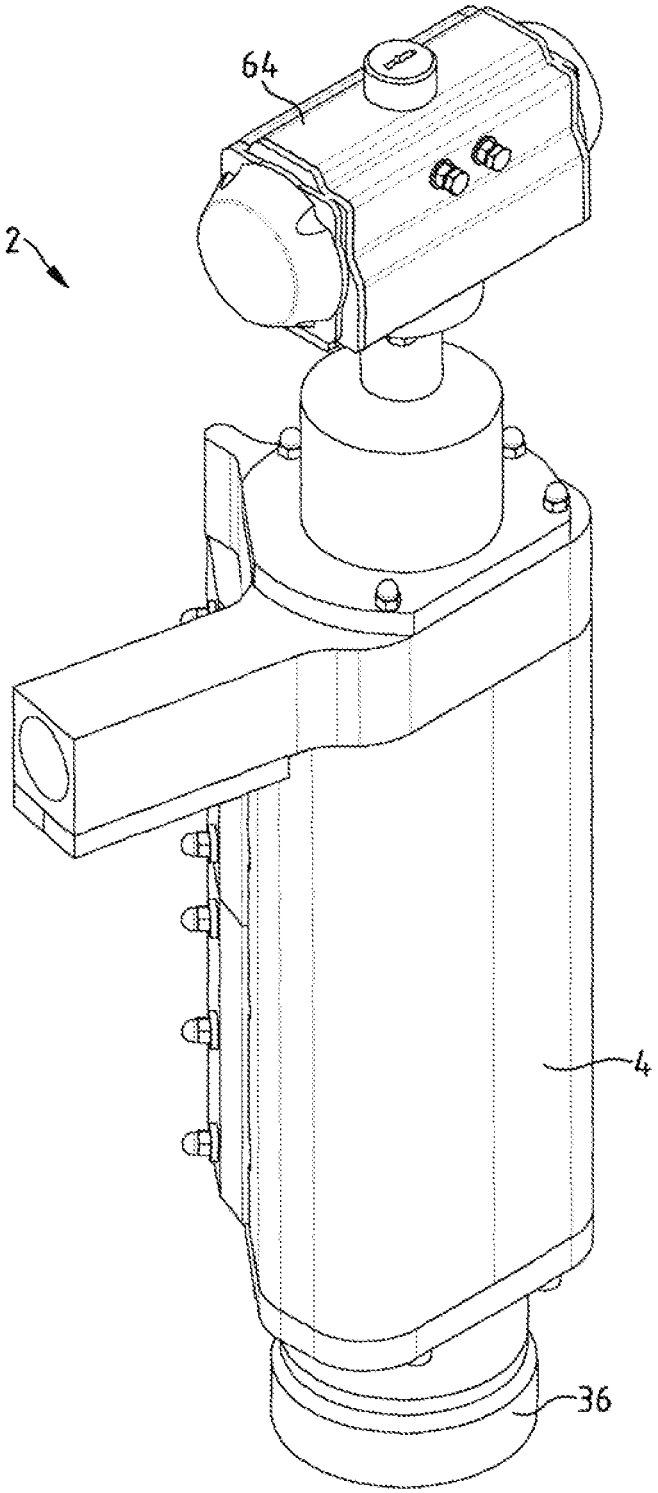
FIG. 1 shows a perspective view of an example nozzle apparatus in accordance with the teachings of this disclosure.
Figure 2:
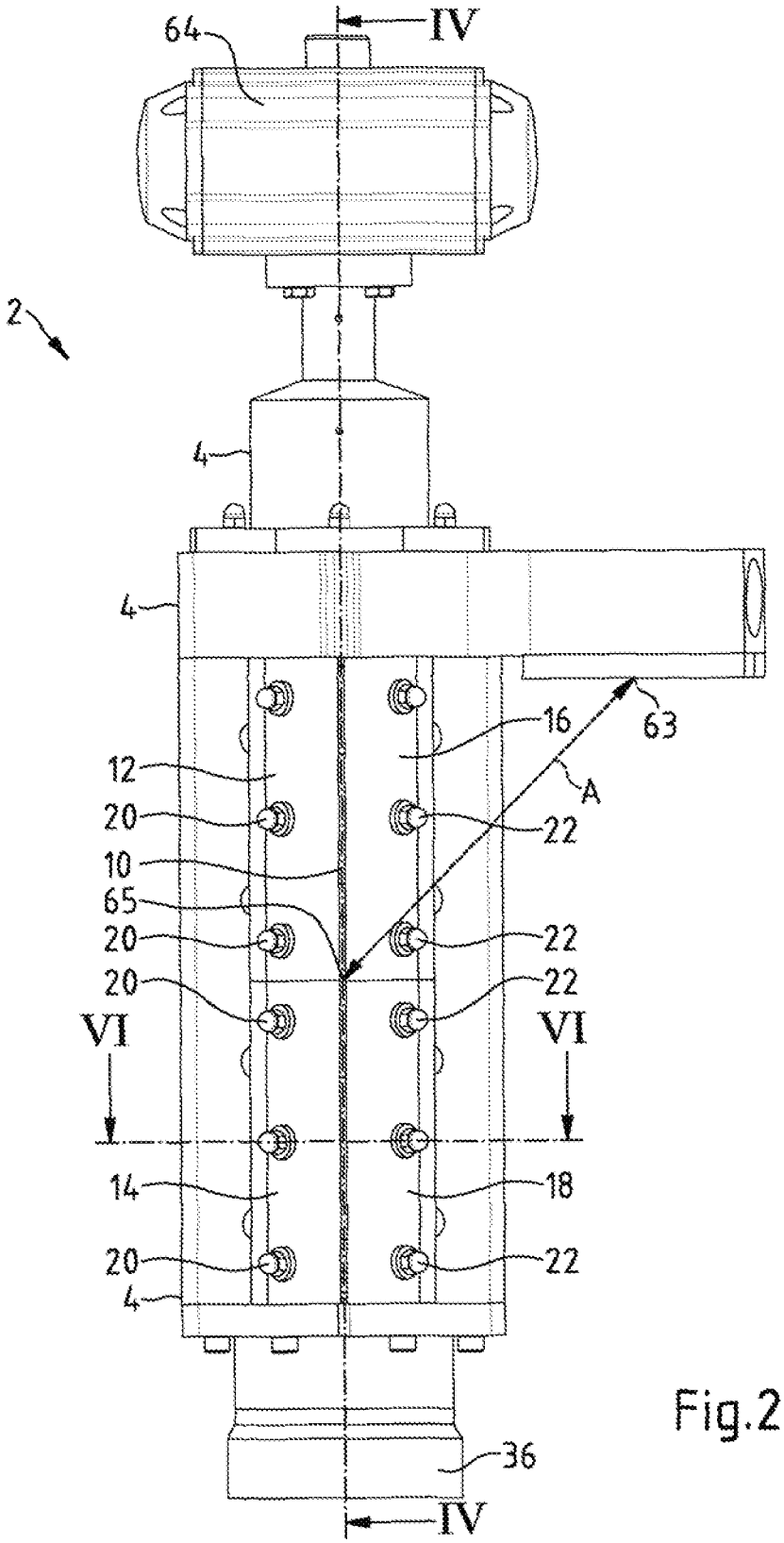
FIG. 2 shows a first side view of the nozzle apparatus of FIG. 1.
Figure 3:
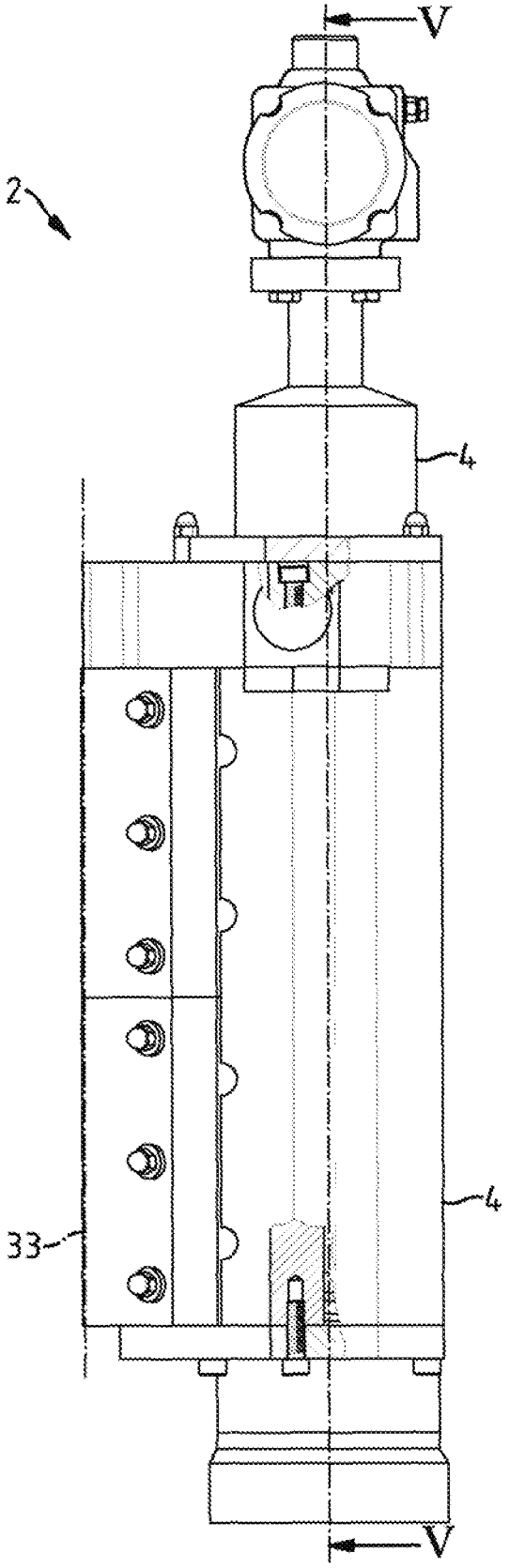
FIG. 3 shows a second side view of the nozzle apparatus of FIG. 1.
Figure 4:
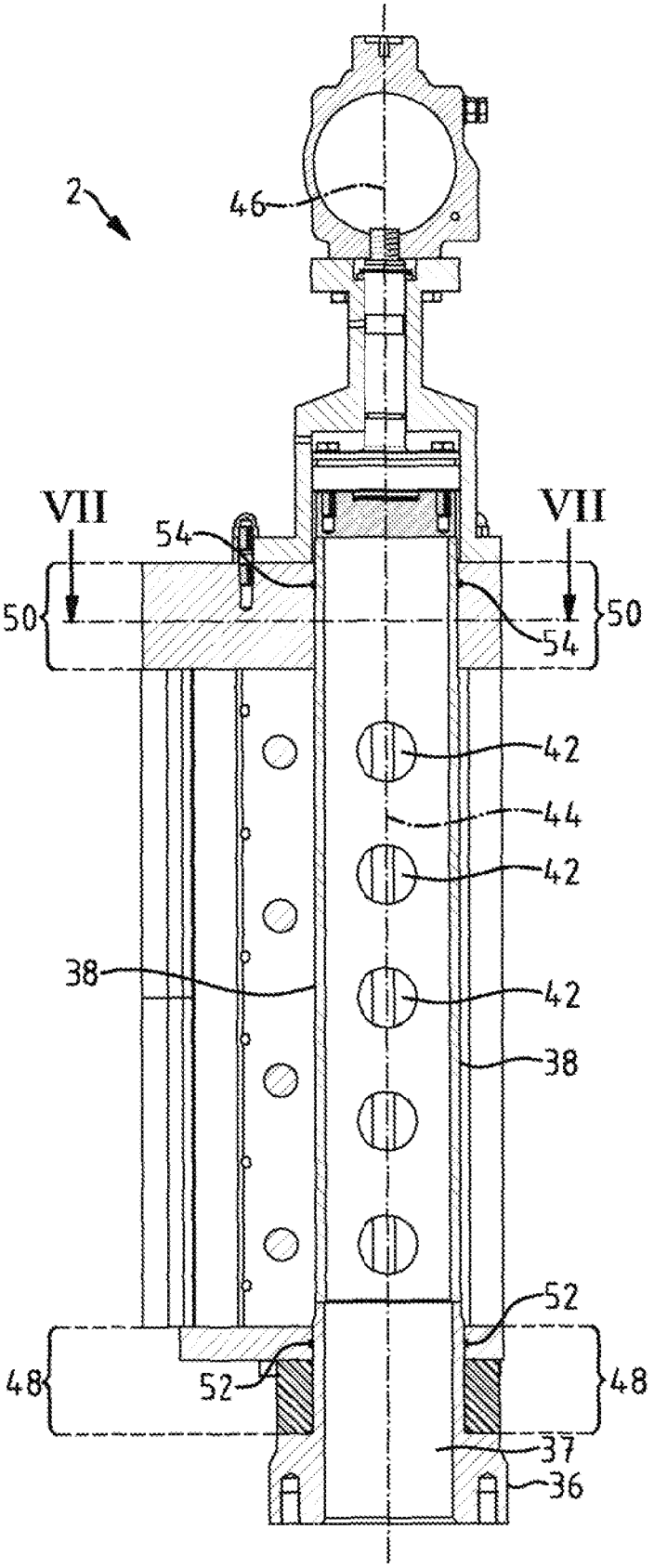
FIG. 4 shows a section of the nozzle apparatus along the line IV-IV in FIG. 2.

The examples disclosed herein relate to example nozzle module and/or apparatus to, for example, flood-wash workpieces in a cleaning container which is filled with a liquid cleaning medium, having an apparatus body which has at least one nozzle chamber. In some examples, the nozzle chamber has at least one nozzle opening for generating at least one fluid stream. In some examples, the nozzle apparatus comprises an example unit for feeding pressurized fluid through a fluid channel into the at least one nozzle chamber, when the unit is connected to the apparatus body. Additionally or alternatively, the examples disclosed herein relate to an apparatus for cleaning workpieces by flood-washing where the apparatus includes at least one nozzle module and/or apparatus.

FIGS. 1 to 8 show an example nozzle module and/or apparatus 2 for flood-washing workpieces in a cleaning container. In the illustrated example, the nozzle apparatus 2 has an apparatus body 4. A first nozzle chamber 6 is formed in the apparatus body 4. The nozzle chamber 6 extends along a longitudinal direction which corresponds to the axis 8 between a bottom section 3 and a ceiling section 5. The nozzle chamber 6 is formed having a slit-shaped nozzle mouth 9 which extends along a slit axis 33. The nozzle chamber 6 has a slit-shaped nozzle opening 10.

Figure 6:
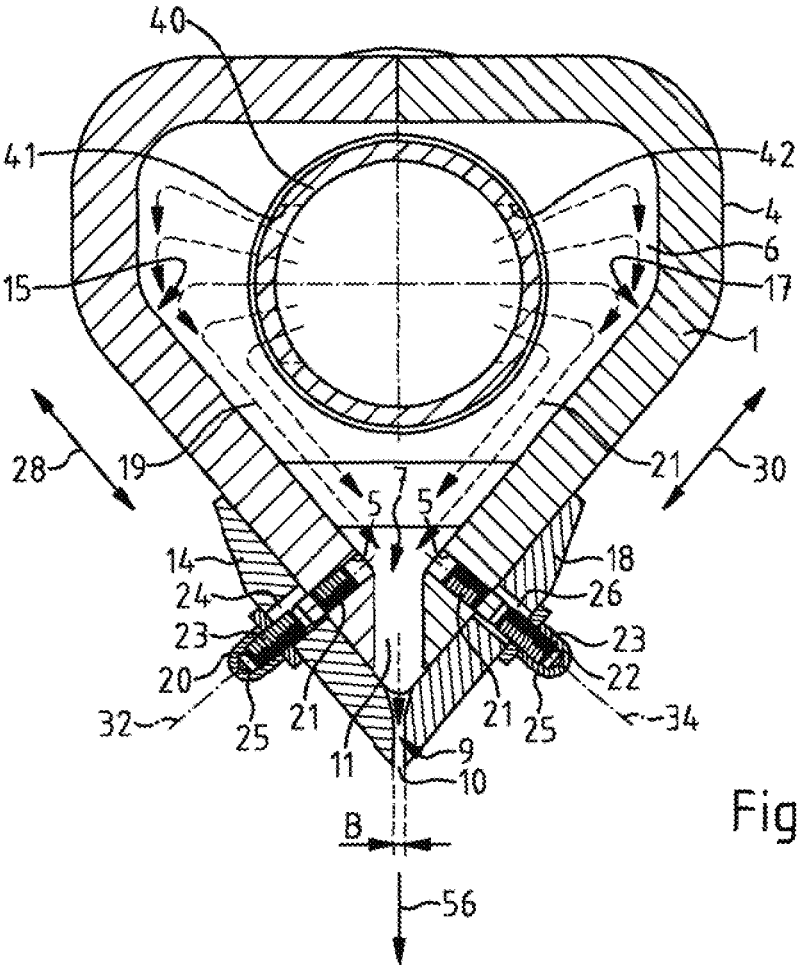
FIG. 6 shows a section of the nozzle apparatus along the line VI-VI in FIG. 2 with a fluid stream.
Figure 8:
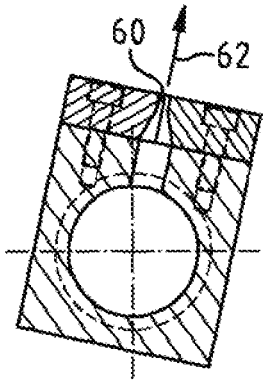
FIG. 8 shows a section of the nozzle apparatus along the line VIII-VIII in FIG. 7.
Figure 7:
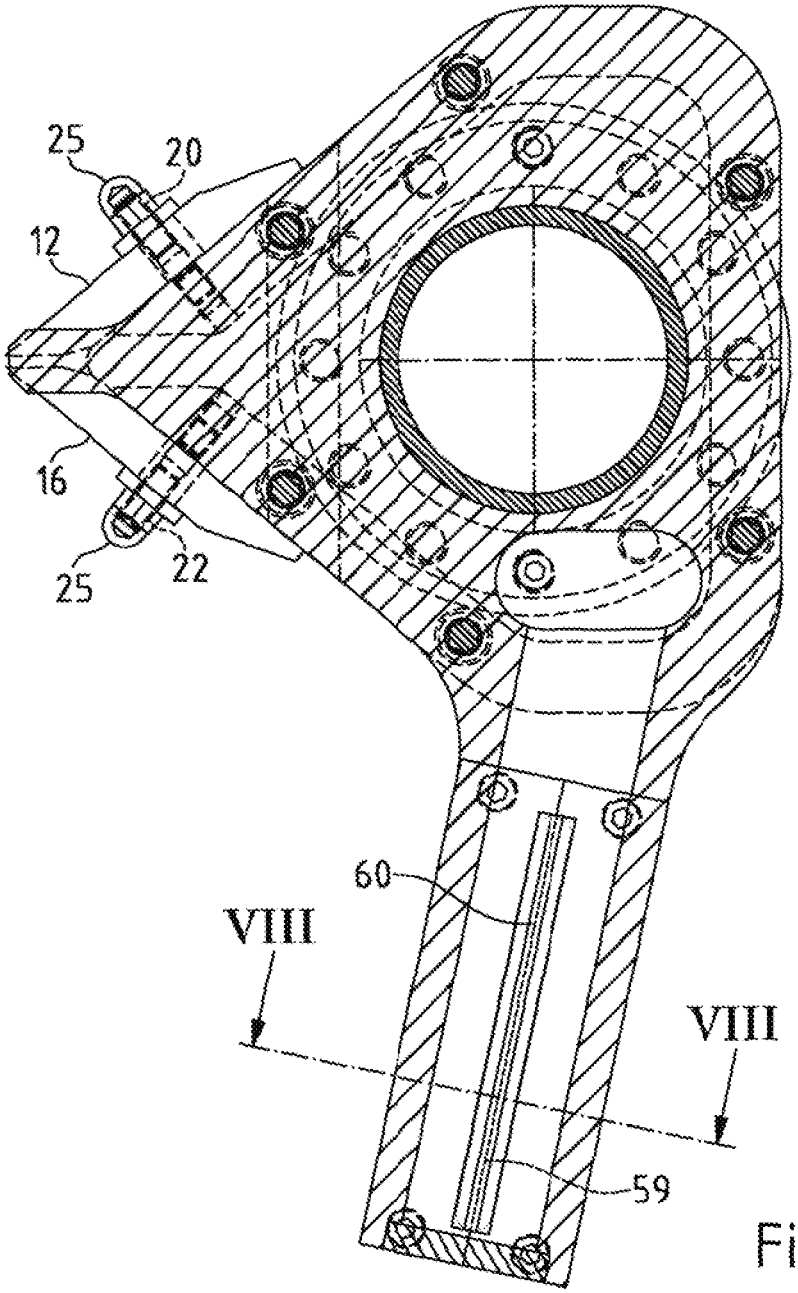
FIG. 7 shows a section of the nozzle apparatus along the line VII-VII in FIG. 4.

In some examples, the width B of the opening slit of the nozzle opening 10 which is illustrated in FIG. 6 is defined by setting elements in the shape of nozzle plates 12, 14, 16 and 18 which are held on the apparatus body 4 by fastening screws 20, 22. The fastening screws 20, 22 have a thread 21 which engages in a thread 5 which is formed on the apparatus body 4. A nut 25 is guided on a thread 23 of the fastening screws and/or other fasteners 20, 22. The nozzle plates 12, 14, 16, 18 are fastenable on the apparatus body 4 by the nut and/or fastener 25. The fastening screws 20, 22 pass through the nozzle plates 12, 14, 16 and 18 via through-holes 24, 26, the diameter of which holes is greater than the diameter of the fastening screws 20, 22. In this manner, the nozzle plates 20, 22 are movable on the apparatus body 4 according to the double-headed arrow 28, 30 substantially perpendicularly relative to the axes 32, 34 of the fastening screws. This enables a setting of the width B of the opening slit of the nozzle opening 10 extending along the slit axis 33 by displacing the nozzle plates 12, 14, 16 and 18 on the apparatus body 4. As used herein, the phrase substantially perpendicularly means within approximately five-degrees of perpendicular and/or accounts for manufacturing tolerances.

In some examples, the apparatus body 4 is connected to a connecting pipe 36 for the feeding of pressurized fluid into the nozzle chamber 6. All types of cleaning media which are gaseous or liquid under standard conditions may be used as fluid, in particular water, aqueous solutions of acids, bases, alcohols or similar, as well as water mixed or enriched with surfactants or gases, as well as gaseous or liquid hydrocarbons in a pure or mixed form, for example. A pressure which is to be provided in accordance with the teachings of this disclosure is, for example, preferably constant between 2 bar and 200 bar (absolute), wherein the delivery pressure of the fluid may also be set to pulsating, (e.g., changing rapidly with a frequency of between 0.5 Hz and 50 Hz), in order to achieve particularly good cleaning results.

In some examples, the connecting pipe 36 is connected to a support section and/or hollow shaft 38. The connecting pipe 36 defines a fluid channel 37 which passes through the hollow shaft 38. The hollow shaft 38 extends through the nozzle chamber 6. The hollow shaft 38 has an open wall 40 with a plurality of openings 42, which are arranged in the wall 40 along the direction 44 of the shaft axis 46. The connecting pipe 36 together with the hollow shaft 38 acts as a unit and/or an assembly 39 for feeding fluid into the nozzle chamber 6. The connecting pipe 36 and the hollow shaft 38 form a hollow body 35. In this example, the hollow body 35 extends through the nozzle chamber 6. In this example, the hollow body 35 supports the apparatus body 4.

In some examples, the apparatus body 4 is mounted to both sides of the nozzle chamber 6 on the hollow body 35 in a first pivot bearing 48 and a second pivot bearing 50. The hollow body 35 supports the apparatus body 4. In some examples, the shaft axis 46 of the hollow shaft 38 is aligned with the rotation axes of the pivot bearings 48, 50. The shaft axis 46 is a pivot axis. The shaft axis 46 extends substantially parallel to the slit axis 33 of the opening slit of the nozzle opening 10. As used herein, the phrase substantially parallel means within approximately five-degrees of parallel and/or accounts for manufacturing tolerances. In this manner, the apparatus body 4 is rotatably mounted on the unit 39 for feeding fluid into the nozzle chamber 6 and is movable about the rotation axis 46. The pivot bearing 48 and the pivot bearing 50 each contain one seal ring 52, 54 made, in some examples, from an elastomeric plastic or any other suitable material. The pivot bearing 48, 50 is sealed with the seal ring 52, 54.

By feeding pressurized fluid into the nozzle chamber 6, a fluid stream 56 with a linear cross section exiting the opening slit of the nozzle opening 10 may be generated.

Figure 5:
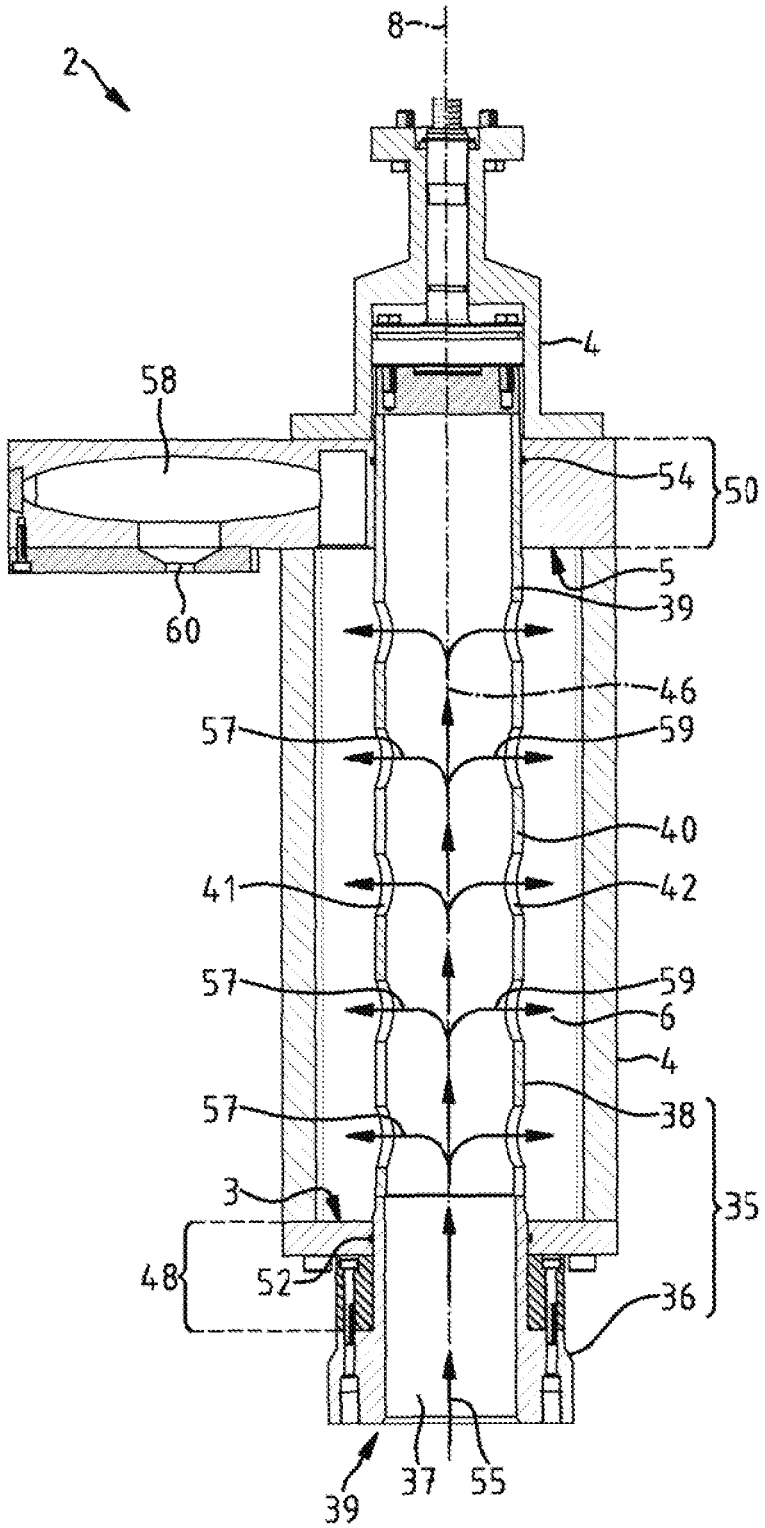
FIG. 5 shows a partial section of the nozzle apparatus along the line V-V in FIG. 3 with a fluid stream.

In this example, in the course of feeding pressurized fluid (e.g., cleaning medium) into the nozzle chamber 6, the fluid stream which is illustrated in FIG. 5 and FIG. 6 is formed in the nozzle apparatus 2. The fluid streams in the direction of the arrow 55 through the connecting pipe 36 into the hollow shaft 38. There, it is guided with a direction of flow corresponding to one of the arrows 57, 59 through the openings 41, 42 in the wall 40 of the hollow shaft 38 into the nozzle chamber 6. There, the fluid streams to the slit-shaped nozzle opening 10, said stream lying in a plane which is substantially perpendicular in relation to the longitudinal direction 8.

In some examples, by feeding the fluid through the plurality of openings 41, 42 in the wall 40 of the hollow shaft 38 of the nozzle chamber 6 between the bottom section 3 and the ceiling section 5, flow conditions which are approximately identical or at least similar between the bottom section 3 and ceiling section 5 on the nozzle chamber 6 are formed ahead of the slit-shaped nozzle opening 10 in the nozzle chamber 6. For the openings 41, 42, circular or oval borings are provided according to the disclosed examples, said borings being arranged at regular spacings from one another. In some examples, the center points of all borings are preferably located in a common plane. Additionally or alternatively, stadium-shaped or slot-shaped openings are provided. In some examples, all rims of the openings 41, 42 are preferably provided with deburred and/or rounded edges, edge radii of 0 5 mm and more being provided.

In some examples, the nozzle chamber 6 has a section 7, the cross section of which is substantially perpendicular to the slit axis 33 has a trough shape or groove shape. The trough-shaped or groove-shaped section 7 opens into an opening slot 11 which is formed in the wall 1 of the apparatus body 4 between the nozzle opening 10 and the nozzle chamber 6.

In some examples, the fluid which streams from the openings 41, 42 in the wall 40 of the hollow body 35 into the nozzle chamber 6 is directed into the section 7 of the nozzle chamber 6 by the wall sections 15, 17 of the nozzle chamber 6 via a stream path corresponding to the arrows 19, 21, said wall sections 15, 17 being located opposite the openings 41, 42. Thus a stagnation pressure, which is substantially constant between the bottom section 3 and ceiling section 5 of the nozzle chamber 6, is created ahead of the opening slot 11 in the nozzle chamber 6. In some examples, the result is that the flow velocity of the fluid stream 56 exiting the nozzle opening 10 is substantially perpendicular to the slit axis 33 and is of equal magnitude along the slit axis 33.

In some examples, the stream path corresponding to the arrows 19, 21 in the section 7 of the nozzle chamber 6 and through the opening slot 11 furthermore has the effect that the fluid stream 56 exiting the nozzle opening 10 does not rupture and/or does not substantially rupture because the stream of the fluid along the stream path corresponding to the arrows 15, 16 is directed into the nozzle mouth 9.

However, if the fluid were to be directed not through the openings 41, 42 in the wall 40 of the hollow shaft 38, but directly through the connecting pipe 36 into the nozzle chamber 6, in some examples, this would result in a stagnation pressure ahead of the opening slot 11 in the nozzle chamber 6, said stagnation pressure increasing from the bottom section 3 towards the ceiling section 5 in the nozzle chamber 6. In this example, the flow velocity of the fluid stream 56 exiting the nozzle opening 10 would differ along the slit axis 33.

In some examples, a further, second nozzle chamber 58, which is illustrated in FIG. 5, is formed in the apparatus body 4. In this example, the further nozzle chamber 58 has a nozzle opening 60. The nozzle opening 60 is also slit-shaped and extends along a slit axis 59. In some examples, the nozzle opening 60 also generates a fluid stream 62 which has a linear cross section. The direction of the fluid stream 62 exiting the nozzle opening 60 and the direction of the fluid stream 56 from the nozzle opening 10 are warped and substantially perpendicular in relation to one another. The nozzle opening 60 has a center 63. The center 63 is spaced from the center 65 of the nozzle opening 10 in accordance with the line A. In relation to the center 65 of the nozzle opening 10, the center 63 of the nozzle opening 60 is displaced in the longitudinal direction of the slit axis 33 of the nozzle opening 10 and laterally offset in relation to the slit axis 33.

For a modified example of the nozzle apparatus 2, two or more further nozzle chambers may be also provided which each have a slit-shaped nozzle opening for generating a slit-shaped fluid stream. These nozzle chambers are connected to the nozzle chamber through which the hollow shaft extends. In some examples, it is favourable to arrange the nozzle openings of these nozzle chambers in such a manner that they generate fluid streams with flow components which are mutually opposed. In this manner, the simultaneous cleaning of workpiece surfaces which are located opposite one another is enabled.

In some examples, the nozzle apparatus 2 contains a drive 64. The drive 64 is implemented as a pneumatic drive. By means of the drive 64, the apparatus body 4 having the slit-shaped nozzle opening 10 can be moved between two or more pivot positions about the shaft axis 46 of the hollow shaft 38. In some examples, during operation, the apparatus body is moved between predefined pivot positions according to requirements and, in some examples, also at a frequency of between 0.1 Hz and 10 Hz. In some examples, this can prove particularly advantageous when a (likewise) pulsating pressurization of the cleaning medium in the nozzle chamber is carried out. In other examples, the apparatus body is pivoted from a predefined cleaning position into a likewise predefined standby position in the course of a replacement of a workpiece to be cleaned. In this manner, it is possible to implement that the nozzle apparatus in the cleaning position penetrates into a depression in the workpiece.

Figure 9:
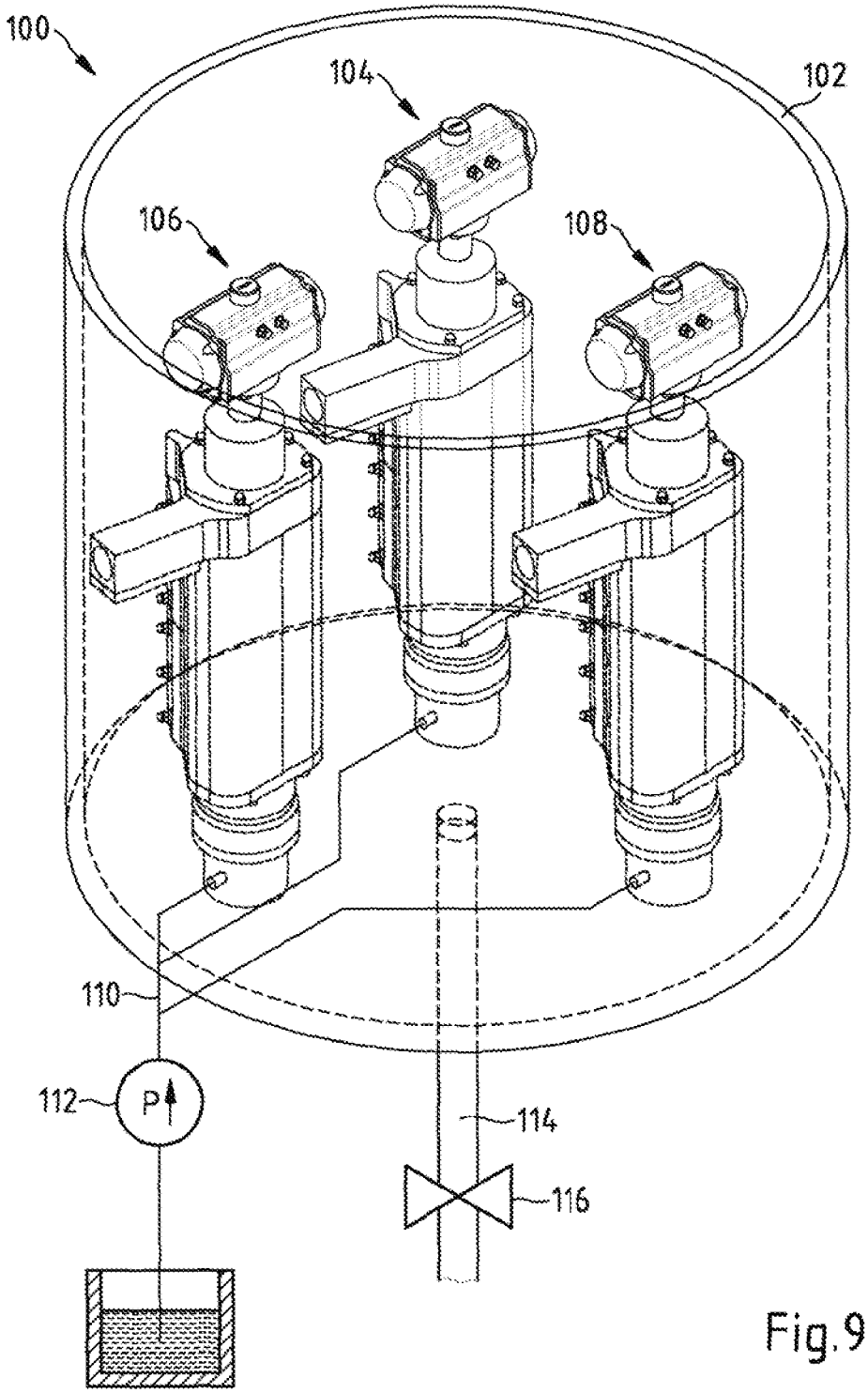
FIG. 9 shows a cleaning apparatus having a plurality of nozzle apparatus.

FIG. 9 shows an example device, apparatus and/or system 100 for cleaning workpieces by flood-washing. The apparatus 100 has a cleaning container 102 which is filled with a cleaning medium (liquid fluid) in the form of water (e.g., heated, depending on requirements, in relation to standard conditions). In the cleaning container 102 there are located a plurality of nozzle modules and/or apparatus 104, 106, 108 which can be supplied with further cleaning medium through a pipe system 110 via a pump 112. Alternatively, such an apparatus for cleaning workpieces may also be provided with a single nozzle apparatus according to the aforementioned description. Optionally, the apparatus for cleaning workpieces has a heating and/or cooling apparatus by which the cleaning medium can be temperature-controlled (e.g., to a temperature which is increased or lowered in relation to standard conditions) within the cleaning container 102.

In some other examples, alternative liquid or gaseous fluids, such as compressed air or organic solvents (e.g., liquid or gaseous hydrocarbons) may be fed to a nozzle apparatus. In other examples, it is provided that at least two nozzle apparatus are supplied with different cleaning media when using a plurality of nozzle apparatus in one cleaning container. In this example, it is provided that at least two different aqueous solutions having additives of different concentrations and/or different chemical compositions are used. It is further preferably provided in this respect that temperature-controlled water is used as a first aqueous solution and water mixed with surfactants or bases is used as a second aqueous solution. In other examples, a combination of water as a first cleaning medium and alcohol (diluted with water) as second cleaning medium is provided. In other examples, a combination of a first cleaning medium which is liquid under standard conditions (e.g. water) and a second cleaning medium which is gaseous under standard conditions (e.g. compressed air) is provided. Optionally, cleaning media which are liquid or gaseous under standard conditions may be used, to which particulate materials (e.g., plastic granules, glass beads, ceramic particles, or similar) have been added. In other examples, other types of liquid or gaseous cleaning media (e.g., fluids) may be fed in arbitrary combination via different nozzle apparatus in accordance with the teachings of this disclosure which, depending on requirements, are spaced from one another.

In other examples, a cleaning medium which is liquid under standard conditions (e.g., water and/or alcohol) on the one hand, and the same cleaning medium to which inert particulate material has been added on the other hand, is applied through a nozzle apparatus according to the disclosed examples. In this example, substantially the same cleaning medium is provided again, in stagnant form, in a cleaning container for the dipping of workpieces therein.

The further cleaning medium should stream according to the disclosed examples in a pressurized, pulsating or continuous manner from a nozzle apparatus according to the disclosed examples. During operation, the cleaning medium streams above and/or below a fluid level of the cleaning medium located in the cleaning container 102 against a workpiece also located in the container 102 and removes particles and/or other contamination from said workpiece. In particular, for implementing a flood-washing operation below the fluid level of the cleaning medium located in the cleaning container, the further cleaning medium is sprayed according to the disclosed examples onto the respective workpiece, the workpiece likewise being positioned below the fluid level. In some examples, the container 102 has a drain 114, which is closable by a valve 116, for the disposal of fluid, by which contaminations removed from the workpiece can be evacuated.

In some examples, an example nozzle module and/or apparatus 2 has an apparatus body 4 which has at least one nozzle chamber 6. The nozzle chamber 6 contains at least one nozzle opening 10 for generating at least one fluid stream 56. In some examples, the nozzle apparatus contains a unit 39 for feeding pressurized fluid through a fluid channel 37 into the at least one nozzle chamber 6. The unit 39 for feeding pressurized fluid is connected to the apparatus body 4. In some examples, the unit 39 for feeding fluid into the at least one nozzle chamber 6 of the apparatus body 4 has a hollow body 35. In some examples, the hollow body 35 extends into the nozzle body 6. In some examples, the hollow body 35 has at least one opening 41, 42 for the influx of fluid into the nozzle chamber 6.

Using the flood-washing workpieces according to the disclosed examples, such contaminations (e.g., cooling lubricant(s), shaving(s), etc.) may be removed. Here, the workpieces are entirely or partially dipped in a fluid bath (e.g., in a cleaning medium which is liquid under standard conditions and, depending on requirements, largely stagnant) and, therein, impacted by a fluid stream which has a high flow velocity. Furthermore, in some examples, nozzle apparatus in flood-washing are preferably operated like the workpieces, entirely or partially below a fluid level of the mentioned fluid bath. Therefore, nozzle apparatus which can provide a fluid stream having a large mass flow rate are used in flood-washing workpieces, a high flow velocity being applied to the fluid streaming out from the nozzle apparatus for this purpose. In some examples, such nozzle apparatus should, therefore, be configured for a comparatively high throughput of fluid per time unit.

An apparatus for cleaning workpieces by flood-washing which contains a nozzle apparatus is known from WO 2009/144073 A2. There, a cleaning apparatus is described which has a cleaning chamber for holding a workpiece to be cleaned. A nozzle apparatus is located in the cleaning apparatus. The nozzle apparatus has an apparatus body with a nozzle chamber. The nozzle chamber is connected to a pipeline as a unit for feeding pressurized cleaning fluid. The nozzle chamber in the apparatus body has a slit-shaped nozzle opening.

In some examples, a nozzle apparatus for an apparatus for cleaning workpieces is provided, by which one or a plurality of fluid streams may be generated which not only have a high flow velocity but also a large mass flow rate.

In some examples, a nozzle apparatus of the type mentioned at the outset in which the unit for feeding pressurized fluid has a hollow body extending into the nozzle chamber where the hollow body has at least one opening for the influx of fluid into the nozzle chamber. In some examples, the nozzle apparatus according to the disclosed examples is that physical limits apply to the throughput of fluid per time unit through a nozzle apparatus. In some examples, when turbulences occur ahead of the nozzle opening in a nozzle chamber, a very large amount of energy is required for generating a fluid stream having a high flow velocity and a large mass flow rate. In some examples, the disclosed examples homogenize or appropriately adjust the fluid stream in the nozzle chamber by the hollow body extending into the nozzle chamber. In some examples, this is preferably achieved in that the hollow body is extended in a longitudinal direction in the nozzle chamber and that the fluid reaches the at least one nozzle opening from the hollow body through the at least one opening with a stream running in a plane which is substantially perpendicular to the longitudinal direction.

In some examples, the nozzle chamber may have a plurality of nozzle openings which are arranged successively in the longitudinal direction, or at least one slot-shaped nozzle opening which extends in the longitudinal direction.

In some examples, the disclosed examples use a unit for feeding fluid into a nozzle chamber not only for the fluid feed into the nozzle chamber, but also to mechanically stabilize the nozzle chamber with it. In this way, the nozzle chamber may be impacted with very high pressures while at the same time being of comparatively lesser material thicknesses and correspondingly reduced weight. It may, in particular, be provided that the hollow body supports the apparatus body.

In some examples, the mechanical stabilization of a nozzle apparatus by a unit for feeding fluid into the nozzle chamber makes possible different installation positions for the nozzle apparatus in a cleaning apparatus, without excessive mechanical stress occurring at the interface locations of the units for feeding fluid and the apparatus bodies in the nozzle apparatus.

In some examples, because the apparatus body is rotatably mounted on the unit for feeding fluid into the at least one nozzle chamber and being movable about a rotation axis, it is possible to generate a fluid stream having a modifiable jet direction. In some examples, this measure makes it possible for a fluidically favourable operating state to be set in the nozzle apparatus. In particular, this also makes it possible to minimize the formation of turbulences inside the nozzle chamber(s).

In some examples, it is advantageous to implement a first mounting region for the support section in the apparatus body and the second mounting region for the hollow body in the apparatus body as a pivot bearing in each case. In this manner, bearing locations for the apparatus body on the unit for feeding fluid into the nozzle chamber are created on sides of the nozzle chamber which lie opposite one another. This ensures that the pivot bearings which support the apparatus body are not impacted by unfavourable torques. In particular, torques having a force component which is substantially perpendicular to the rotation axis of the pivot bearings are substantially avoided.

In some examples, because the hollow body is formed as a hollow shaft which has a wall with a plurality of openings for the passing through of fluid into the at least one nozzle chamber between the first and the second mounting region for the apparatus body, a particularly rigid design of the nozzle apparatus may be achieved and/or obtained. In some examples, the openings are preferably located between the first and the second mounting region for the apparatus body, with a uniform distance to one another. In some examples, it is advantageous that the shaft axis of the hollow shaft is aligned with the rotation axis of the pivot bearings. As a result, in some examples, the pivot bearings can be sealed in this example against high fluid pressures against the wall of the hollow shaft with one or a plurality of elastomeric seal rings (for example "O rings").

In some examples, a nozzle opening may be configured for generating a fluid stream having a linear cross section, in particular as a slit which extends along a slit axis. In particular, in some examples, the nozzle chamber may have a section with a groove-shaped or trough-shaped cross section which is substantially perpendicular to the axis and which opens into an opening slot. In some examples, this opening slot is formed in the wall of the apparatus body between the nozzle mouth and the nozzle chamber. The fluid is fed into the nozzle mouth by at least two wall sections of the nozzle chamber which redirect the fluid exiting from two openings in the hollow body which are located opposite one another. The wall of the nozzle chamber then directs the stream path into the section of the nozzle chamber which has a groove-shaped or trough-shaped cross section, said section opening into the opening slot.

In some examples, in the case of a rotatable apparatus body, it is favourable for the slit axis to extend parallel to the rotation axis of the apparatus body. In some examples, it is advantageous for the apparatus body to have adjustable setting elements by means of which the geometry of the slit-shaped nozzle mouth, in particular the width (B) of the slit-shaped nozzle mouth, can be varied. This measure enables the fluid stream on the nozzle apparatus to be configurable and adaptable to the type of contamination and the degree of contamination of workpieces.

In some examples, a drive may be provided for moving the apparatus body in relation to the unit for feeding fluid into the at least one nozzle chamber. A suitable drive is, for example, a pneumatic drive which may also be reliably operated in the humid or chemically aggressive atmosphere created by cleaning media.

In some examples, based on a plurality of nozzle chambers having nozzle openings being provided in a nozzle apparatus according to the disclosed examples, it is possible to simultaneously clean different surfaces of workpieces. For example, the at least one (first) nozzle chamber in the apparatus body may be connected to at least one further nozzle chamber in the apparatus body. In some examples, the nozzle chambers preferably each have a nozzle opening for generating in each case one fluid stream (or a plurality of fluid streams which are substantially identically oriented). In some examples, it is favourable for the jet direction of the fluid stream exiting the at least one nozzle opening of the at least one (first) nozzle chamber and the jet direction of the nozzle jet which exits from the nozzle opening of the further fluid chamber to be oriented at an acute angle or warped in relation to one another. In other examples, the mentioned jet directions are arranged substantially perpendicularly to one another.

In some examples, it is particularly advantageous for the at least one (first) nozzle chamber in the apparatus body to be connected to at least two further nozzle chambers in the apparatus body. In some examples, the further nozzle chambers favourably each have a nozzle opening for generating a first and a second further fluid stream with a jet direction which is warped at an acute angle or substantially perpendicular in relation to the jet direction of a fluid jet exiting the at least one nozzle opening of the at least one (first) nozzle chamber. In some examples, as a result of this first and second further fluid stream having at least one mutually opposed flow component, it is possible to simultaneously clean surfaces of workpieces which are located opposite one another. In some examples, it may in particular be provided that the first and the second further fluid stream are oriented in mirror symmetry in relation to the fluid stream exiting the at least one (first) nozzle chamber, wherein the fluid stream exiting the at least one (first) nozzle chamber extends along one mirror plane.

In some examples, the nozzle openings of the further nozzle chambers may also be of slit shape and extend along a slit axis. In some examples, it is particularly advantageous for the nozzle opening of at least one further nozzle chamber for generating a further fluid stream to have a center which is spaced from the center of a nozzle opening of the at least one (first) nozzle chamber. In relation to the support section of the unit for feeding fluid into the at least one (first) nozzle chamber, the nozzle opening of the further nozzle chamber in this case is displaced in the longitudinal direction and located laterally offset.

In some examples, in a device and/or apparatus for cleaning workpieces by flood-washing, one or a plurality of nozzle apparatus according to the disclosed examples may be operated in a cleaning container for holding workpieces which is preferably completely or partially filled with a cleaning fluid. Preferably, in some examples, at least one nozzle apparatus according to the disclosed examples may be arranged such that a fluid stream exiting from a nozzle opening of the nozzle apparatus impacts a workpiece which is positioned below a fluid level of the cleaning fluid in the cleaning container. For flood-washing workpieces, in some examples, the nozzle apparatus are in this case in particular operated using a cleaning fluid (e.g. water) which is liquid under normal conditions, the cleaning fluid containing in particular certain cleaning additives (for example, surfactants, bases, or similar), having a temperature preferably between approximately 50° C. and 120° C., and being pressurized, preferably at a pressure between approximately 2 bar and 200 bar, further preferably at a pressure between approximately 5 bar and 20 bar.

As set forth herein, an example nozzle module and/or apparatus (2) configured for flood-washing workpieces in a cleaning container (102) which is filled with a liquid cleaning medium, includes an apparatus body (4) having at least one nozzle chamber (6) which has at least one nozzle opening (10) for generating at least one fluid stream (56), and having a unit (39) for feeding pressurized fluid through a fluid channel (37) into the at least one nozzle chamber (6). The unit is connected to the apparatus body (4) in which the unit (39) for feeding pressurized fluid has a hollow body (35) extending into the nozzle chamber (6). The hollow body having at least one opening (41, 42) for the influx of fluid into the nozzle chamber (6).

In some examples, the hollow body (35) is extended in a longitudinal direction (8) in the nozzle chamber (6) and that the fluid reaches the at least one nozzle opening (10) from the hollow body (35) through the at least one opening (41, 42) with a stream (57, 59) running in a plane which is substantially perpendicular to the longitudinal direction (8).

In some examples, the nozzle chamber (6) has a plurality of nozzle openings which are arranged successively in the longitudinal direction (8) or has at least one slot-shaped nozzle opening (10) which extends in the longitudinal direction (8).

In some examples, the hollow body (35) supports the apparatus body (4).

In some examples, the apparatus body (4) is rotatably mounted on the unit (39) for feeding fluid into the at least one nozzle chamber (6) and is movable about a rotation axis (46).

In some examples, the hollow body (35) extends at least from a first mounting region (48) for the apparatus body (4) through the at least one nozzle chamber (6) to a second mounting region (50) for the apparatus body (4).

In some examples, the hollow body (35) is at least partly formed as hollow shaft (38) which has a wall (40) having a plurality of openings (42) for the passing through of fluid into the at least one nozzle chamber (6) between the first mounting region (48) for the apparatus body (4) and the second mounting region (50) for the apparatus body (4).

In some examples, the first mounting region for the apparatus body (4) and the second mounting region (50) for the apparatus body (4) is a pivot bearing (48, 50).

In some examples, the hollow shaft (38) has a shaft axis (46) which is aligned with the rotation axis (46) of the pivot bearings (48, 50).

In some examples, the at least one nozzle opening (10) for generating a fluid stream (56) having a linear cross section (1) has a slit-shaped nozzle mouth (9) which extends along a slit axis (33).

In some examples, the nozzle chamber (6) has a section (7) having a cross section which is substantially perpendicular to the slit axis (33). In some examples, the section (7) is trough-shaped and opens into an opening slot (11) which is formed in the wall (1) of the apparatus body (4) between the nozzle mouth (9) and the nozzle chamber (6), the fluid being fed to said opening slot (11) through at least two openings (41, 42) in the hollow body (35) via stream paths (19, 21) which are directed by wall sections (15, 17) of the nozzle chamber (6) into the section (7) having the trough-shaped cross section and opening into the opening slot (11), said wall sections (15, 17) being located opposite the openings (41, 42).

In some examples, the apparatus body (4) is rotatable and the slit axis (33) is parallel to the rotation axis (46) of the apparatus body (4).

In some examples, the apparatus body (4) has adjustable setting elements (12, 14, 16, 18) to enable the geometry of the slit-shaped nozzle mouth (9), in particular the width (B) of the slit-shaped nozzle mouth (9), to be varied.

In some examples, the apparatus body (4) is movable in relation to the unit (39) for the feeding of fluid into the at least one nozzle chamber (6) by a drive (64), which is preferably implemented as pneumatic drive.

In some examples, the at least one nozzle chamber (6) in the apparatus body (4) has a nozzle opening (10) for generating a (first) fluid stream (56) where the at least one nozzle chamber (6) is connected to at least one further nozzle chamber (58) in the apparatus body (4). The at least one further nozzle chamber (58) has at least one further nozzle opening (60) for generating a further fluid stream (62) where the further fluid stream has a jet direction (61) which is warped, at an acute angle or substantially perpendicular in relation to the jet direction (55) of the first fluid stream (56).

In some examples, the at least one nozzle chamber (6) in the apparatus body (4) has a nozzle opening (10) for generating a (first) fluid stream (56) where the at least one nozzle chamber is connected to at least two further nozzle chambers (58) in the apparatus body (4). In some examples, the further nozzle chambers (58) in each case having one nozzle opening (10) for generating at least a first and a second further fluid stream (62) where the first (56) and the second further fluid stream (62) in each case have a jet direction which is oriented at an acute angle or warped or substantially perpendicular in relation to the jet direction of the first fluid stream (56) and where the first (56) and the second further fluid stream (62) have at least one mutually opposed flow component.

In some examples, at least one further nozzle chamber (58) has a slit-shaped nozzle opening (60) which extends along a slit axis (59).

In some examples, an apparatus (100) for cleaning workpieces by flood-washing, having a cleaning container (102) for holding workpieces, pressurized cleaning medium being fed into said cleaning container (102) via at least one nozzle apparatus (104, 106, 108) according disclosed examples.

In some examples, a nozzle apparatus (2) for the generation of at least one fluid stream (56) having a high flow velocity and a large mass flow rate has an apparatus body (4) having at least one nozzle chamber (6) which has at least one nozzle opening (10) for generating at least one fluid stream (56), and having a unit (39) for feeding pressurized fluid through a fluid channel (37) into the at least one nozzle chamber (6). The unit is connected to the apparatus body (4). The unit has a hollow body (35) extending into the nozzle chamber (6) in the longitudinal direction (8). The hollow body has at least one opening (41, 42) for the influx of fluid into the nozzle chamber (6) through which the fluid reaches the at least one nozzle opening (10) from the hollow body (35) with a stream (57, 59) running in a plane which is substantially perpendicular to the longitudinal direction (8) in which the apparatus body (4) is rotatably mounted on the unit (39) and is movable about a rotation axis (46) where the at least one nozzle opening (10) for generating a fluid stream (56) having a linear cross section (1) has a slit-shaped nozzle mouth (9) which extends along a slit axis (33). In some examples, the nozzle chamber (6) opens into an opening slot (11) which is formed in the wall (1) of the apparatus body (4) between the nozzle mouth (9) and the nozzle chamber (6) where the fluid being fed to said opening slot (11) through the at least one opening (41, 42) in the hollow body (35) via a stream path (19, 21) which is directed by wall sections (15, 17) of the nozzle chamber (6) to the opening slot (11), said wall sections (15, 17) being located opposite the openings (41, 42).

In some examples, the nozzle chamber (6) has a section (7) having a trough-shaped cross section which is substantially perpendicular to the slit axis (33) and which opens into the opening slot (11).

In some examples, the nozzle chamber (6) has a plurality of nozzle openings which are arranged successively in the longitudinal direction (8) or has at least one slot-shaped nozzle opening (10) which extends in the longitudinal direction (8).

In some examples, the hollow body (35) extends at least from a first mounting region (48) for the apparatus body (4) through the at least one nozzle chamber (6) to a second mounting region (50) for the apparatus body (4).

In some examples, the hollow body (35) is at least partly formed as a hollow shaft (38) which has a wall (40) having a plurality of openings (42) for the passing through of fluid into the at least one nozzle chamber (6) between the first mounting region (48) for the apparatus body (4) and the second mounting region (50) for the apparatus body (4).

In some examples, the first mounting region for the apparatus body (4) and the second mounting region (50) for the apparatus body (4) is a pivot bearing (48, 50).

In some examples, the hollow shaft (38) has a shaft axis (46) which is aligned with the rotation axis (46) of the pivot bearings (48, 50).

In some examples, the apparatus body (4) is rotatable and the slit axis (33) is parallel to the rotation axis (46) of the apparatus body (4).

In some examples, the apparatus body (4) has adjustable setting elements (12, 14, 16, 18) by means of which the geometry of the slit-shaped nozzle mouth (9), in particular the width (B) of the slit-shaped nozzle mouth (9), can be varied.

In some examples, the apparatus body (4) is movable in relation to the unit (39) for the feeding of fluid into the at least one nozzle chamber (6) by means of a drive (64), which is preferably implemented as a pneumatic drive.

In some examples, the at least one nozzle chamber (6) in the apparatus body (4) has a nozzle opening (10) for generating a (first) fluid stream (56) where the at least one nozzle chamber (6) is connected to at least one further nozzle chamber (58) in the apparatus body (4). The at least one further nozzle chamber (58) has at least one further nozzle opening (60) for generating a further fluid stream (62) where the further fluid stream has a jet direction (61) which is warped at an acute angle or substantially perpendicular in relation to the jet direction (55) of the first fluid stream (56).

In some examples, the at least one nozzle chamber (6) in the apparatus body (4) has a nozzle opening (10) for generating a (first) fluid stream (56) where the at least one nozzle chamber is connected to at least two further nozzle chambers (58) in the apparatus body (4). In some examples, the further nozzle chambers (58) in each case having one nozzle opening (10) for generating at least a first and a second further fluid stream (62) where the first (56) and the second further fluid stream (62) in each case have a jet direction which is oriented at an acute angle or warped or perpendicular in relation to the jet direction of the first fluid stream (56) and where the first (56) and the second further fluid stream (62) have at least one mutually opposed flow component.

In some examples, at least one further nozzle chamber (58) has a slit-shaped nozzle opening (60) which extends along a slit axis (59). In some examples, an apparatus (100) for cleaning workpieces by flood-washing has a cleaning container (102) for holding workpieces, pressurized cleaning medium being fed into said cleaning container (102) via at least one nozzle apparatus (104, 106, 108) according to the disclosed examples.

An example method for flood-washing a workpiece in a cleaning container (102) includes providing a cleaning container (102) and an arrangement of the workpiece in the cleaning container (102) and simultaneous impacting the workpiece by a first fluid stream (56) which is directed from a first nozzle chamber (6) in a nozzle apparatus (2) through a slit-shaped nozzle opening (10). The fluid stream includes a liquid cleaning medium, and by a further fluid stream (62), which includes of a liquid cleaning medium through a further nozzle chamber (58) which is arranged in the nozzle apparatus (2) and which communicates with the first nozzle chamber (6), said further fluid stream (62) having a jet direction (61) which is warped, at an acute angle or perpendicular in relation to the jet direction (55) of the first fluid stream (56).

In some examples, the workpiece is dipped in the liquid cleaning medium and positioned below the fluid level in the course of the impacting by the first and the further fluid stream (56, 62) in the cleaning container (102).

It is noted that this patent claims priority from International Patent Application No. PCT/EP2012/050631 which was filed on Jan. 17, 2012, which claims priority to German Patent Application No. 10 2011 004 232.6, which was filed on Feb. 16, 2011, both of which are hereby incorporated herein by reference in their entireties.

Although certain example methods, apparatus and articles of manufacture have been described herein, the scope of coverage of this patent is not limited thereto. On the contrary, this patent covers all methods, apparatus and articles of manufacture fairly falling within the scope of the claims of this patent.

What is claimed is:

1. A nozzle apparatus for the generation of at least one fluid stream, the nozzle apparatus comprising:

a body having a nozzle chamber comprising a nozzle opening for generating a fluid stream, wherein the body is rotatably mounted on a unit and is movable about a rotation axis, wherein the nozzle opening comprises a wall and a slit-shaped nozzle mouth extending along a slit axis, and wherein the nozzle chamber opens into an opening slot formed in the wall of the body between the nozzle mouth and the nozzle chamber, fluid being fed to the opening slot through an opening in a hollow body via a stream path directed by wall sections of the nozzle chamber to the opening slot, wherein the wall sections are located opposite the opening.

2. The nozzle apparatus of claim 1, wherein the nozzle chamber comprises a section having a trough-shaped cross section that is substantially perpendicular to the slit axis and opens into the opening slot.

3. The nozzle apparatus of claim 1, wherein the nozzle chamber comprises a plurality of nozzle openings arranged successively in a longitudinal direction or the nozzle chamber comprises at least one slot-shaped nozzle opening that extends in the longitudinal direction.

4. The nozzle apparatus of claim 1, wherein the hollow body of the unit extends from a first mounting region of the body through the nozzle chamber to a second mounting region of the body.

5. The nozzle apparatus of claim 4, wherein the hollow body comprises a hollow shaft comprising a wall having openings through which fluid is to pass into the nozzle chamber between the first mounting region of the body and the second mounting region of the body.

6. The nozzle apparatus of claim 5, wherein the first mounting region of the body and the second mounting region of the body comprise a pivot bearing.

7. The nozzle apparatus of claim 6, wherein the hollow shaft has a shaft axis which is aligned with the rotation axis.

8. The nozzle apparatus of claim 6, wherein the rotation axis comprises a rotation axis of the pivot bearing.

9. The nozzle apparatus of claim 1, wherein the slit axis is substantially parallel to the rotation axis.

10. The nozzle apparatus of claim 9, wherein the rotation axis comprises a rotation axis of the body.

11. The nozzle apparatus of claim 1, wherein the body comprises adjustable settings to adjust a geometry of the slit-shaped nozzle mouth.

12. The nozzle apparatus of claim 1, wherein a width of the slit-shaped nozzle mouth is adjustable.

13. The nozzle apparatus of claim 1, wherein the body is movable relative to the unit to enable a drive to feed fluid into the nozzle chamber.

14. The nozzle apparatus of claim 13, wherein the drive comprises a pneumatic drive.

15. The nozzle apparatus of claim 1, wherein the nozzle chamber of the body comprises a first nozzle opening for generating a first fluid stream, wherein the nozzle chamber is coupled to a second nozzle chamber of the body, the second nozzle chamber comprises a second nozzle opening for generating a second fluid stream, and wherein the second fluid stream comprises a jet direction that is warped at an acute angle or substantially perpendicular relative to the jet direction of the first fluid stream.

16. The nozzle apparatus of claim 15, wherein the nozzle chamber is coupled to a third nozzle chamber of the body, the third nozzle chamber comprises a third nozzle opening for generating a third fluid stream, wherein the third fluid stream comprises a jet direction oriented at an acute angle, warped, or substantially perpendicular in relation to the jet direction of the first fluid stream, and wherein the second and third fluid streams have at least one mutually opposed flow component.

17. The nozzle apparatus of claim 16, wherein one of the second nozzle chamber or the third nozzle chamber comprises a slit-shaped nozzle opening that extends along a slit axis.

18. An apparatus for cleaning workpieces by flood-washing, comprising:

a body having a nozzle chamber comprising a nozzle opening for generating a fluid stream;

a unit for feeding pressurized fluid through a fluid channel into the nozzle chamber, wherein the unit is coupled to the body, wherein the unit comprises a hollow body extending into the nozzle chamber in a longitudinal direction, wherein the hollow body comprises an opening for the influx of fluid into the nozzle chamber through which the fluid reaches the nozzle opening from the hollow body with a stream running in a plane substantially perpendicular to the longitudinal direction; and a cleaning container for holding workpieces, wherein a pressurized cleaning medium is to be fed into a cleaning container via a nozzle apparatus comprising the body, wherein the body is rotatably mounted on the unit and is movable about a rotation axis, wherein the nozzle opening comprises a wall and a slit-shaped nozzle mouth extending along a slit axis, and wherein the nozzle chamber opens into an opening slot formed in the wall of the body between the nozzle mouth and the nozzle chamber, the fluid being fed to the opening slot through the opening in the hollow body via a stream path directed by wall sections of the nozzle chamber to the opening slot, wherein the wall sections are located opposite the openings.

* * * * *